US007919707B2

(12) United States Patent
Harvey et al.

(10) Patent No.: US 7,919,707 B2
(45) Date of Patent: Apr. 5, 2011

(54) MUSICAL SOUND IDENTIFICATION

(75) Inventors: David Harvey, London (GB); Daniel Spreadbury, Middlesex (GB); Paul Walmsley, London (GB); Jonathan Finn, London (GB)

(73) Assignee: Avid Technology, Inc., Burlington, MA (US)

( * ) Notice: Subject to any disclaimer, the term of this patent is extended or adjusted under 35 U.S.C. 154(b) by 407 days.

(21) Appl. No.: 12/135,117

(22) Filed: Jun. 6, 2008

(65) Prior Publication Data

US 2009/0301288 A1 Dec. 10, 2009

(51) Int. Cl.
*G10H 7/00* (2006.01)

(52) U.S. Cl. ..... 84/645

(58) Field of Classification Search ..... 84/645
See application file for complete search history.

(56) References Cited

U.S. PATENT DOCUMENTS

| | | | | |
|---|---|---|---|---|
| 5,734,119 | A * | 3/1998 | France et al. | 84/622 |
| 6,696,631 | B2 * | 2/2004 | Smith et al. | 84/645 |
| 7,045,700 | B2 * | 5/2006 | Hämäläinen et al. | 84/645 |
| 7,105,737 | B2 * | 9/2006 | Frangopol et al. | 84/615 |
| 7,232,948 | B2 * | 6/2007 | Zhang | 84/600 |
| 7,396,990 | B2 * | 7/2008 | Lu et al. | 84/611 |
| 7,680,814 | B2 * | 3/2010 | Mercer et al. | 84/600 |
| 7,754,959 | B2 * | 7/2010 | Herberger et al. | 84/626 |
| 2002/0161462 | A1 * | 10/2002 | Fay et al. | 700/94 |
| 2005/0016360 | A1 * | 1/2005 | Zhang | 84/600 |
| 2007/0107584 | A1 * | 5/2007 | Kim et al. | 84/612 |
| 2008/0184869 | A1 * | 8/2008 | Smith et al. | 84/609 |

OTHER PUBLICATIONS

Ackermann, "Direct Manipulation of Temporal Structures in a Multimedia Application Framework", 1994, Switzerland, 8 pages.

* cited by examiner

*Primary Examiner* — Jeffrey Donels
(74) *Attorney, Agent, or Firm* — Oliver Strimpel

(57) ABSTRACT

Systems and methods for identifying musical sounds are provided. In one implementation, a method includes receiving a collection of sound identifiers. Each sound identifier in the collection identifies a sound. Each sound identifier is associated with a corresponding audio representation. The collection of sound identifiers is used to construct a hierarchy of sound identifiers where each sound identifier appears only once in the hierarchy of sound identifiers. The hierarchy of sound identifiers is arranged according to a musical similarity between the sounds identified by the collection of sound identifiers. A selection of a first sound identifier is received. The first audio representation corresponding to the first sound identified by the first sound identifier is unavailable. The second sound identifier identifies a second sound that is musically similar to the first sound identified by the first sound identifier. An available second audio representation corresponding to a second sound identifier is provided.

18 Claims, 9 Drawing Sheets

MUSICAL SOUND IDENTIFICATION

TECHNICAL FIELD

This subject matter is generally related to musical sound identification, classification, and substitution.

BACKGROUND

Musical keyboards can allow a musician to create and perform musical compositions using the sounds available on the musical keyboard. Some keyboards are MIDI ("Musical Instrument Digital Interface") keyboards. MIDI is an industry-standard protocol that facilitates communication, control, and synchronization between electronic musical instruments, computers, and other equipment (e.g., sound modules and sound libraries).

A MIDI capable device transmits digital data (e.g., event messages) related to the musical notes to be played. For example, MIDI transmitted digital data can include pitch, intensity, and control signal data (e.g., for parameters such as volume, vibrato, panning, and tempo) for a particular sound. The digital data identifying a particular sound can be hard-coded into a MIDI capable device. When different numbering systems are used by different MIDI capable devices, it is often difficult for a musician to identify and use available sounds, especially when using multiple MIDI capable devices.

SUMMARY

A musician can create a musical composition. To play the musical composition on a MIDI capable device, certain musical sounds need to be available on the MIDI capable device. Available sounds usable on a particular MIDI capable device or between MIDI capable devices can be easily identified using a hierarchical structure representing all sounds including all available sounds. Additionally, available sounds that are musically similar can be easily identified and substituted for one another. Thus, musical sounds available on a particular MIDI capable device and needed to play a particular musical composition can be identified as available.

Musical sounds unavailable on a particular MIDI capable device and needed to play a particular musical composition can be identified as unavailable. Additionally, available musical sounds in the system (or other available musical sounds on the MIDI capable device) can be substituted for unavailable musical sounds on the MIDI capable device. Available sounds can be used to play the musical composition requiring the musical sounds that are unavailable on the MIDI capable device.

In general, in one aspect, a computer implemented method is provided. The computer implemented method includes receiving a collection of sound identifiers. Each sound identifier in the collection identifies a sound. Additionally, each sound identifier is associated with a corresponding audio representation. The collection of sound identifiers is used to construct a hierarchy of sound identifiers where each sound identifier appears only once in the hierarchy of sound identifiers. The hierarchy of sound identifiers is arranged according to a musical similarity between the sounds identified by the collection of sound identifiers.

A selection of a first sound identifier is received. The first audio representation corresponding to the first sound identified by the first sound identifier is unavailable. An available second audio representation corresponding to a second sound identifier is provided. The second sound identifier identifies a second sound that is musically similar to the first sound identified by the first sound identifier.

Other embodiments of this aspect include corresponding systems, apparatus, and computer program products.

These and other embodiments can optionally include one or more of the following features. Identifying a sound can include describing a sound using one or more elements. Musical similarity between sounds in the hierarchical tree can be determined based upon parameters including both an acoustic similarity and a musical suitability. The collection of sound identifiers can include sound identifiers from one or more sources. A set of sound identifiers identifying available audio representations for a specific device can be created. A sound identifier can represent silence.

In general, in another aspect, a computer implemented method is provided. The computer implemented method includes receiving a first sound identifier from a collection of sound identifiers arranged in a hierarchical structure. Each sound identifier in the hierarchical structure identifies a sound having a corresponding audio representation. The audio representation for a first sound identified by the first sound identifier is determined to be unavailable. The audio representation for a second sound is determined to be available. The second sound is musically similar to the first sound. The second sound is identifiable by a second sound identifier. The audio representation for the second sound identified by the second identifier is provided.

Other embodiments of this aspect include corresponding systems, apparatus, and computer program products.

These and other embodiments can optionally include one or more of the following features. Identifying a sound can include describing a sound using one or more elements. Musical similarity between sounds in the hierarchical structure can be determined based upon several parameters including an acoustic similarity and a musical suitability. Determining that the audio representation for a second sound is available can include checking the availability of audio representations corresponding to sounds in the hierarchical structure. The availability of audio representations in the hierarchical structure can be checked in an order. The order can include checking descendants of the first name, checking descendants of the parent of the first name, checking descendants of the grandparent of the first name, and checking descendants of the root node.

In general, in another aspect, a computer implemented method is provided. The computer implemented method includes receiving a hierarchical collection of sound identifiers, Each sound identifier identifies a sound. Each sound identifier is associated with a particular audio representation. A selection of a first sound identifier is received. The first audio representation corresponding to the first sound identified by the first sound identifier is unavailable. An available second audio representation is provided. The available second audio representation corresponds to a second sound that is musically similar to the first sound identified by the first sound identifier.

Other embodiments of this aspect include corresponding systems, apparatus, and computer program products.

These and other embodiments can optionally include one or more of the following features. Each sound identifier can appear only once in the hierarchical collection of sound identifiers. The hierarchical collection of sound identifiers can be arranged according to a musical similarity between the sounds identified by the collection of sound identifiers.

In general, in another aspect, a computer program product, encoded on a computer-readable medium is provided. The computer program product is operable to cause data processing apparatus to perform operations including receiving a first collection of sound identifiers. Each sound identifier in the first collection identifies a sound. Each sound identifier in the first collection is associated with a particular audio representation. A second collection of sound identifiers is received from a first device. Each sound identifier in the second collection identifies a sound. Each sound identifier in the second collection is associated with an available audio representation of a sound on the first device. The second collection of sound identifiers is a subset of the first collection of sound identifiers. The second collection of sound identifiers is used to indicate available audio representations of sounds in the first collection of sound identifiers.

In general, in another aspect, a system is provided. The system includes a musical playback device. The musical playback device includes a memory operable for storing a collection of sound identifiers arranged in an prioritized hierarchical structure. Each sound identifier in the ordered hierarchical structure identifies a sound using one or more descriptive elements. Each sound has a corresponding available audio representation on the musical playback device.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference symbols in the various drawings indicate like elements.

DETAILED DESCRIPTION

Figure 1A:
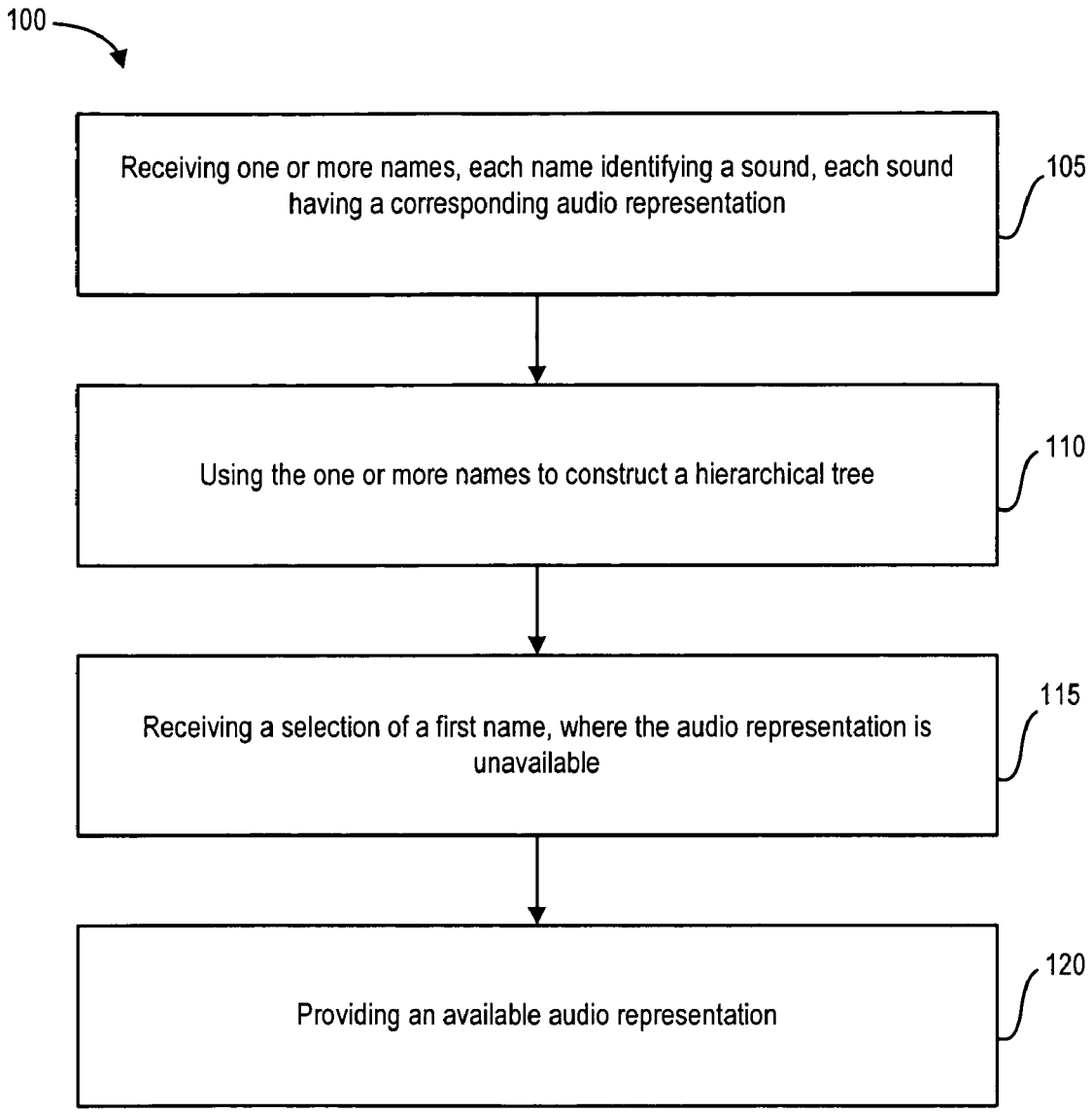
FIG. 1A shows a flowchart of an example method for organizing and using names identifying sounds.

FIG. 1A shows a flowchart of an example method 100 for organizing and using names identifying sounds. For convenience, the method 100 will be described with reference to a system that performs the method 100. The system (e.g., a computer and an application), receives 105 one or more names or sound identifies (e.g., "sound IDs") identifying one or more sounds. A sound ID can represent one or more qualities of a sound regardless of how the sound is generated (e.g., played live, sampled, or synthesized). For example, a quality of a sound can be a name of a family of instruments that an instrument making the sound belongs to. Thus, a quality of a flute sound could be "woodwind" because flutes belong to the woodwind family. The qualities of a sound can be used to distinguish different types of sounds using one or more descriptive elements (e.g., "woodwind").

For example, qualities of musical instruments in the woodwind family can be described beginning with the element "woodwind". Qualities of individual instruments within a family of musical instruments can also be described using an element representing the name of the individual instrument. For example, a flute, which is a musical instrument in the woodwind family, can be described beginning with the element "woodwind" followed by the element "flute". In some implementations, a sound ID uses a Unicode string to describe a sound including one or more elements, by separating each element using a period. For example, a sound ID for a flute could read "woodwind.flute". Thus, the sound ID "woodwind.flute" could refer to the qualities of any flute-like sound regardless of how the sound is generated.

Sound IDs can be grouped together into a set or "sound world". A sound world has a name expressed as a unique non empty Unicode string that can be displayed in a graphical user interface (e.g., "Sibelius Standard Sound World"). A sound world name can be used to identify the origin of a sound ID. A sound world includes a set of sound IDs that can be referred to by a music program (e.g., on a computer or a musical device). The sound IDs in a sound world can be used to construct 110 an ordered hierarchical structure (e.g., a tree) representing the sound world. In some implementations, different combinations of sound IDs can be used in different sound worlds.

Figure 1B:
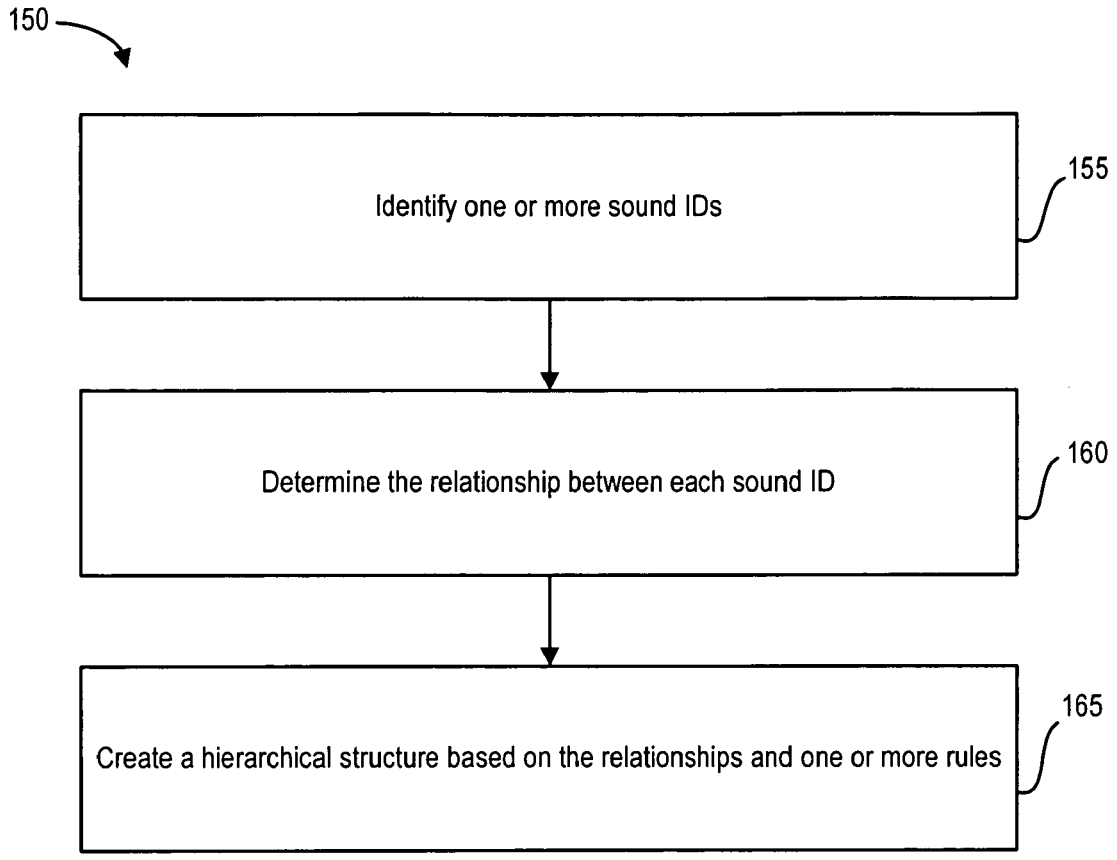
FIG. 1B shows a flowchart of an example method for organizing names identifying sounds into a hierarchical structure.

FIG. 1B shows a flowchart of an example method 100 for organizing sound IDs into a hierarchical structure. For example, the system can identify 155 each received sound IDs according to the qualities or elements included in that sound ID. Based on the elements included in a sound ID, the system can determine a relationship between each received sound ID. For example, if the system receives a first sound ID labeled "woodwind.flute" and a second sound ID labeled "woodwind.clarinet", the system would determine that these two sound IDs are related.

Based on the relationships between the received sound IDs, the system can create 165 a hierarchical structure representing the received sound IDs. In some implementations, to construct the hierarchical structure, the system can apply one or more rules to the received sound IDs. The one or more rules (e.g., ornament before dynamic), can be used to prioritize the relationships between the received sound IDs used to create the hierarchical structure.

The hierarchical structure can represent sound IDs originally received and used to create the sound world. Sound IDs originally in a sound world (e.g., sound IDs that are included in an application in the system) are referred to as primary IDs. Sound IDs later added to an existing sound world (e.g., from a musical device) are referred to as secondary IDs. With the exception of silence, each sound ID can appear only once within the same sound world. Silence is considered to be the infinitely quiet version of any sound and thus may be an element of many distinct sounds in a sound world.

The sounds identified by the set of sound IDs may or may not have corresponding available audio representations. Selecting a sound ID can allow access to an available audio representation corresponding to the sound identified by the sound ID. In some implementations, available audio representations can exist within the system that includes the sound world. In other implementations, available audio representations can exist within a different system or on a musical device.

A sound world supports a basic substitution rule. For example, as shown in FIG. 1A, a selection of a sound ID can be received 115 (e.g., for playing one or more notes in a musical composition). When the audio representation corresponding to the sound identified by the selected sound ID is unavailable, an available audio representation corresponding to a sound identified by a different sound ID can be provided 120. Sound ID substitution will be discussed below with respect to FIGS. 3-5.

Figure 2:
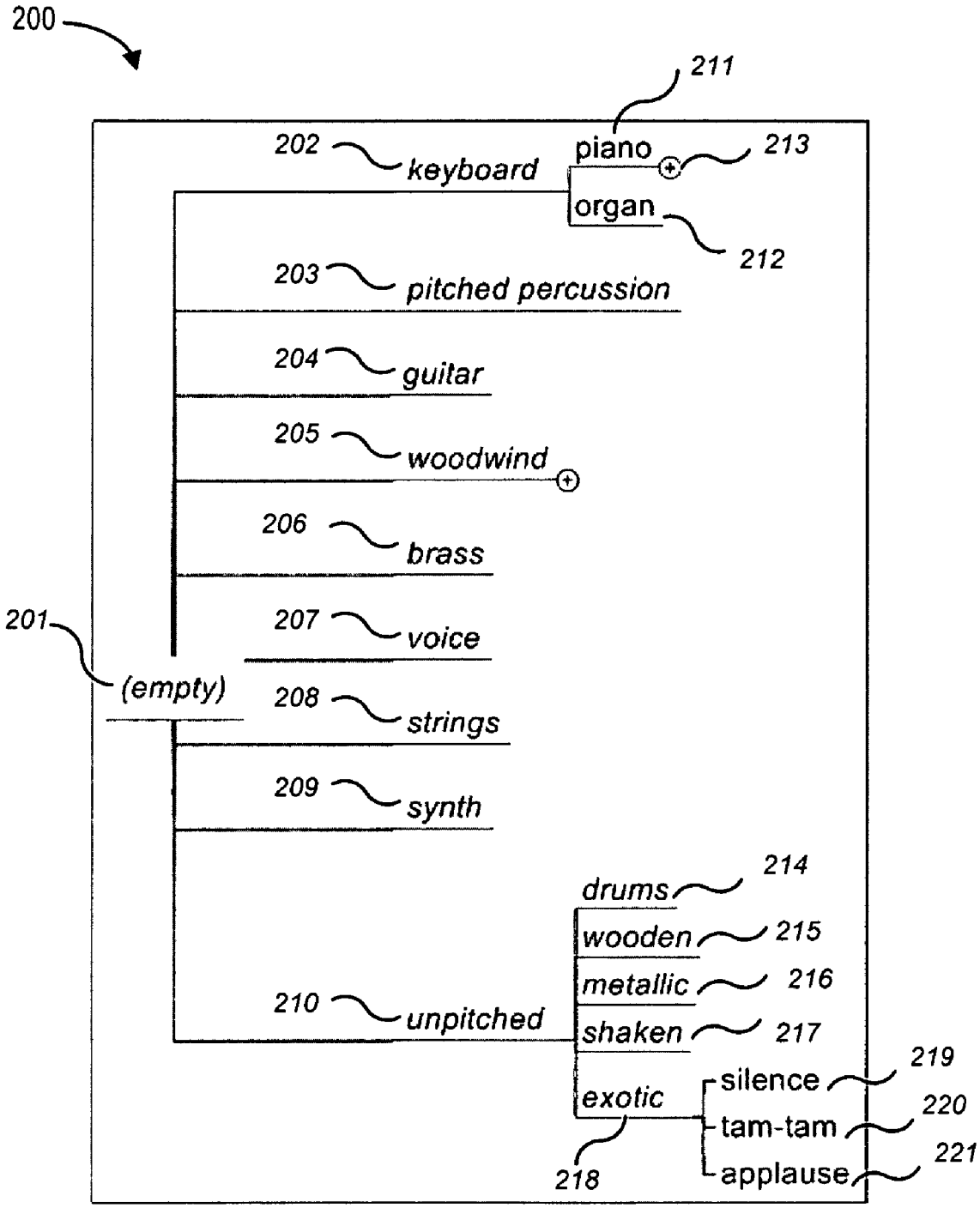
FIG. 2 is an example hierarchical structure for organizing names identifying sounds.

FIG. 2 is an example hierarchical structure 200 for organizing sound IDs identifying sounds. In the example shown, the hierarchical structure 200 or "sound world" includes ten categories or basic elements describing qualities of musical instruments in that sound world. The elements are arranged hierarchically with an "empty" element 201 at the root. A first level of elements (e.g., parent elements) stemming from the root include a keyboard element 202, a pitched percussion element 203, a guitar element 204, a woodwind element 205, a brass element 206, a voice element 207, a strings element 208, a synth (i.e., synthesizers) element 209, and an unpitched element 210.

The first level of elements are prioritized from top to bottom according to one or more pre-determined rules. For example, a rule can require that all keyboard instruments are prioritized above all woodwinds instruments, and all pitched instruments are prioritized above all unpitched instruments. Thus, in the example shown, the keyboard element 202 has a higher priority than the woodwind element 205 and the unpitched element 210. In another example, the order of the first level elements in hierarchical structure 200 can varied to place the unpitched element 210 above the woodwind element 205. Other elements in the hierarchical structure 200 can be organized in other ways (e.g., in a standard orchestral order).

A second level of elements (e.g., child elements) stemming from the keyboard element 202 includes a piano element 211 and an organ element 212. A graphic indication 213 (e.g., a circle with a "+" inside) indicates that another level of elements (e.g., a third level of elements or grandchildren elements) stem from the piano element 211. A user can select the piano element 211 to view third level elements that stem from the piano element 211. In some implementations, the hierarchical structure can include more than three levels of elements (e.g., great-grandchildren elements).

To hide the third level elements that stem from the piano element 211, the user can select the piano element 211 a second time. Likewise, to hide the piano element 211 and the organ element 212, a user can select the keyboard element 202 while the piano element 211 and the organ element 212 are visible. When the piano element 211 and the organ element 212 are hidden, a graphic indication will be displayed at the end of the keyboard element 202 indicating that a second level of elements stem from the first level keyboard element 202.

In some implementations, the highest priority element in the first set of elements in the hierarchy includes a first level keyboard element 202. The first level keyboard element 202 can include a second level piano element 211, and a third level "grand" element (not shown). In these implementations, if an element other than a keyboard element is determined to be unavailable, the system can fall back to the empty element 201 and then substitute the highest available priority element (e.g., keyboard.piano.grand) for the unavailable element. Other substitutions for unavailable elements are possible as will be discussed in greater detail below with respect to FIGS. 3-5.

A second level of elements stemming from the un-pitched element 210 includes a drums element 214, a wooden element 215, a metallic element 216, a shaken element 217, and an exotic element 218. A third level of elements stemming from the exotic element 218 includes a silence element 219, a tam-tam element 220, and an applause element 221. In some implementations, the un-pitched elements 210 are at the bottom of the structure so that they are used as substitutes for pitched elements (e.g., elements 202-210) only when no pitched elements are available. In some implementations, a silence element 219 is used as a substitute for unusual elements having no suitable musical substitute. As noted above, substituting elements will be discussed in greater detail below with respect to FIGS. 3-6.

In some implementations, additional elements can be used to describe musical qualities such as musical effects. Musical effects can include an ornament indication (e.g., tremolo, glissando, flutter-tongue, etc.), a macro quality performance technique indication (e.g., pizzicato, snares on, etc.), an ensemble indication (e.g., ensemble, solo, etc.), a duration indication (e.g., staccato, legato, etc.), an attack or dynamics indication (e.g., accent, crescendo, fortepiano, vibrato, etc.), a micro quality performance technique indication (e.g., mute-.cup, mute.straight, hard stick, soft stick, upbow, downbow, etc.), a number of players indication (e.g., 2 players), a repetition or speed indication (e.g., slow or fast), a length modifier indication (e.g., long or short), and a variant indication (e.g., 2).

In some implementations, elements representing effects can be added to a sound ID in a particular order, and thereby placing the element at a particular level within the hierarchy, according to the importance an effect has on creating a sound. For example, if the importance of an ornamental effect (e.g., flutter-tongue) to a particular sound (e.g., woodwind.flute) outweighs a dynamic effect (e.g., accent) for that same sound, the sound ID for the sound would list the ornamental effect before the dynamic effect (e.g., woodwind.flute.flutter-tongue.accent).

Figure 3:
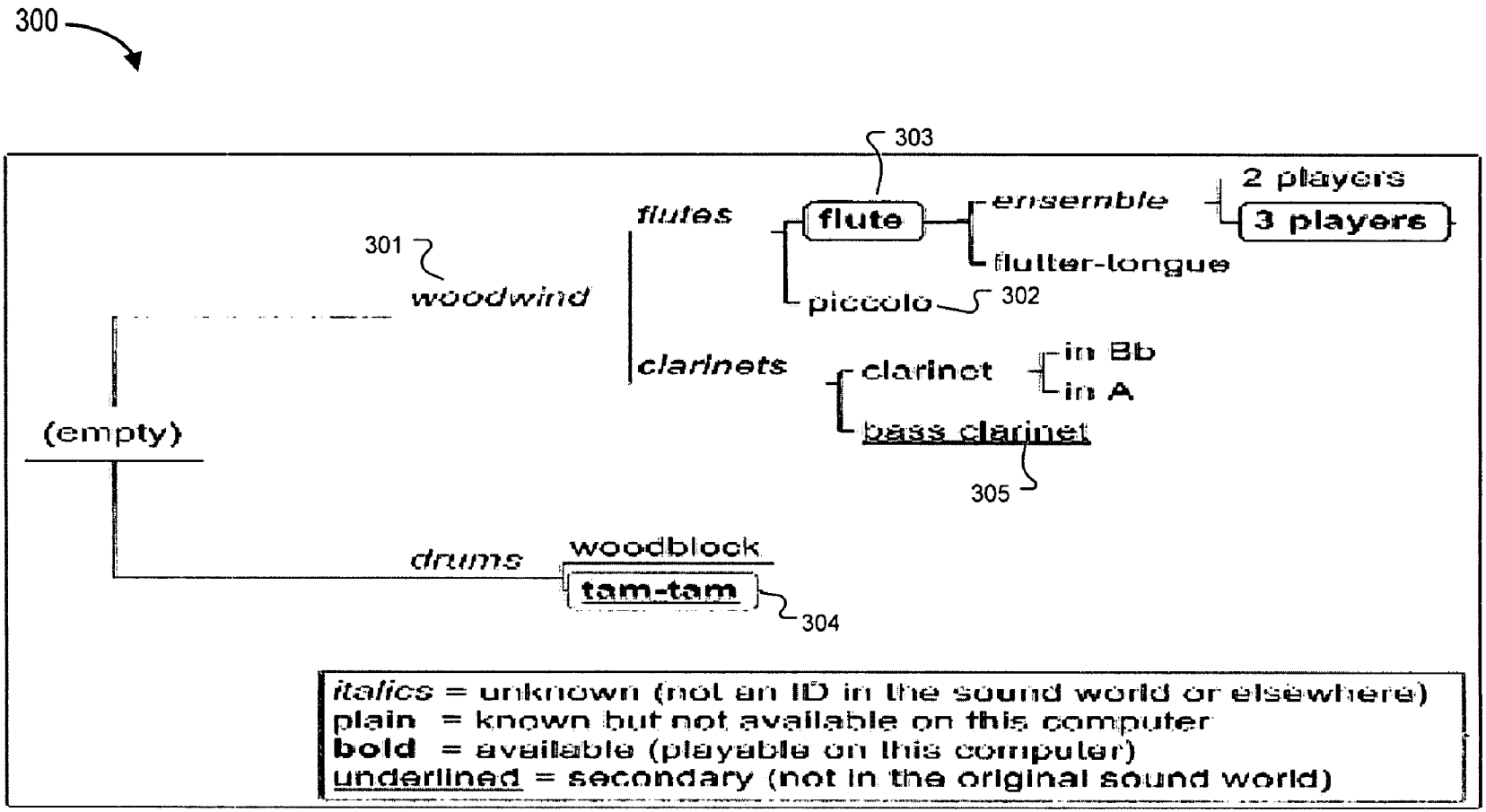
FIG. 3 is an example hierarchical structure for identifying available audio representations of sounds.

FIG. 3 is an example hierarchical structure 300 for identifying sounds having available audio representations. Hierarchical structure or "sound world" 300 is in the form of a hierarchical tree; however, other hierarchical structures are possible. Hierarchical tree 300 is a visual representation of a sound world. In some implementations, hierarchical tree 300 can represent a portion of a larger sound world. The sound world 300 includes several types of sound IDs arranged in a hierarchy of elements similar to that described in FIG. 2. Each sound ID includes a visual indication of an available audio representation. In the example shown, the sound world includes a visual representation of all known sound IDs in a particular system (e.g., on a particular computer).

The sound IDs displayed in italicized text (e.g., woodwind 301), are unknown or unfamiliar to the current system implementing the sound world 300. The sound IDs displayed in plain text (e.g., piccolo 302) are known in the sound world 300 but unavailable to be performed in the current system (e.g., sound IDs that have no available audio representation). The sound IDs displayed in bold text (e.g., flute 303 and tam-tam 304) are known in the sound world 300 and available to be performed in the current system (e.g., sound IDs that have an available audio representation).

Sound IDs displayed with an underline (e.g., bass clarinet 305 and tam-tam 304) represent secondary sound IDs. Secondary sound IDs are any sounds IDs added to an existing sound world from a MIDI capable musical device, or any sounds created in a different system and opened in the current system. In the example shown, the secondary sound ID tam-tam 304 is available to be performed in the current system but the secondary sound ID bass clarinet 305 is not available to be performed in the current system.

Each sound ID identifies a sound to a varying degree of specificity. For example the sound ID "keyboard.piano" is a more specific identification of a sound than the sound ID "keyboard.piano.grand". Each sound ID can allow access to an available audio representation of that sound. In some implementations, in order to perform a note (e.g., from a musical score) using an audio representation of a sound, a system (e.g., the application) requires certain information including the sound ID, the sound world where the sound ID exists, any commands (e.g., MIDI bank or program number data) needed to play the audio representation of the sound identified by the sound ID, and any optional parameters required to play the note (e.g., pitch, duration, volume, etc.). In some implementations, the system also checks capabilities of a MIDI capable playback device (e.g., a MIDI capable keyboard).

Figure 4:
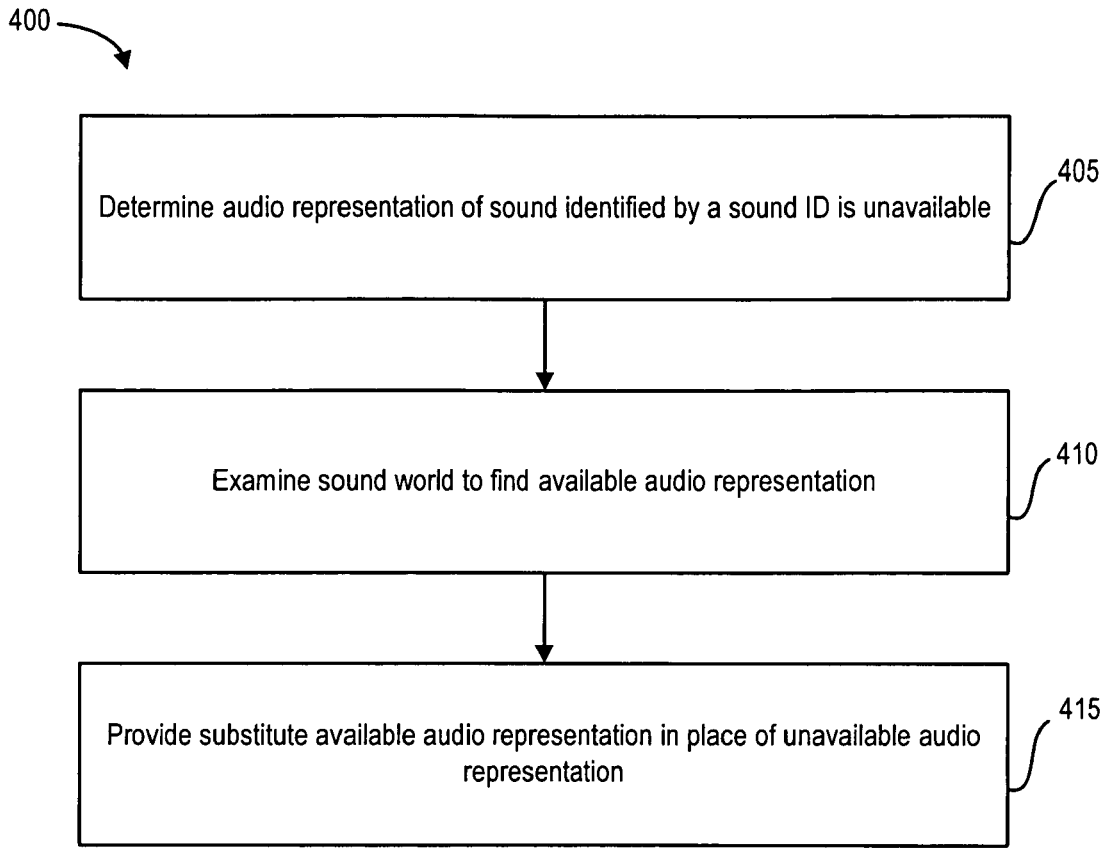
FIG. 4 shows a flowchart of an example method for substituting available audio representations of sounds for unavailable representations of sounds.

FIG. 4 shows a flowchart of an example method 400 for substituting available audio representations of sounds for unavailable representations of sounds. In some implementations, when the system determines 405 that the audio representation of a sound identified by a sound ID is unavailable, the system can examine 410 the sound world to find an available audio representation of a sound identified by a different sound ID. In these implementations, the system can provide 415 the substitute available audio representation in place of the unavailable audio representation. In some implementations, sound IDs can be substituted for one another based on their proximity to one another in a hierarchical structure representing the sound world where they exist. In some implementations, the sound IDs in the sound world are arranged and prioritized according to a number of factors including acoustic similarity (e.g., are the sounds identified by the sound IDs acoustically similar), and musical suitability (e.g., are the sounds identified by the sound IDs suitable to be substituted for one another).

A sound world can be limited in the availability of audio representations of sound IDs. For example, available audio representations in a sound world can be limited to the sound ID violin.arco and the sound ID guitar.picked. In this example, an audio representation corresponding to the sound ID violin.pizzcato is unavailable. Thus, the system could provide an available audio representation corresponding to the sound ID violin.arco as a substitute instead of a guitar-.picked. In this example, the musical similarity between two violin sounds is greater than the musical similarity between a violin sound and a guitar sound. Additionally, while a picked guitar sound is closer in length to a pizzicato violin sound, in the hierarchical structure of a particular sound world, the similarity between the instruments can take priority over the way the notes are played. Thus, sound ID violin.arco (having the greatest musical similarity to the sound ID violin.pizzicato), would be provided as the first choice of a substitute for the sound ID violin.pizzicato despite the availability of the guitar sound.

In some implementations, when the audio representation of the sound identified by a selected sound ID is unavailable, the system finds an available sound ID (and corresponding audio representation) by first checking the availability of any children of the sound ID or the descendants of any children of the sound ID. The system will check children of sound IDs in order from first to last. Thus, the first child descendent of a sound ID must be more similar to the sound ID than any other children of that same sound ID. For example, the first child can contain the basic or most representative sound, and the other children can contain variations (e.g., accents or mutes) which cause them to be slightly different than the first child and less similar to the sound ID. If the system does not find an available descendent sound, the system will next look in order to descendants of the parent of the sound ID, descendants of the grandparent of the sound ID, and ultimately descendants of the root. Descendants of the root are available sounds anywhere in the hierarchical structure (e.g., elements from other branches or leaves like keyboard.piano.steinway).

Figure 5:
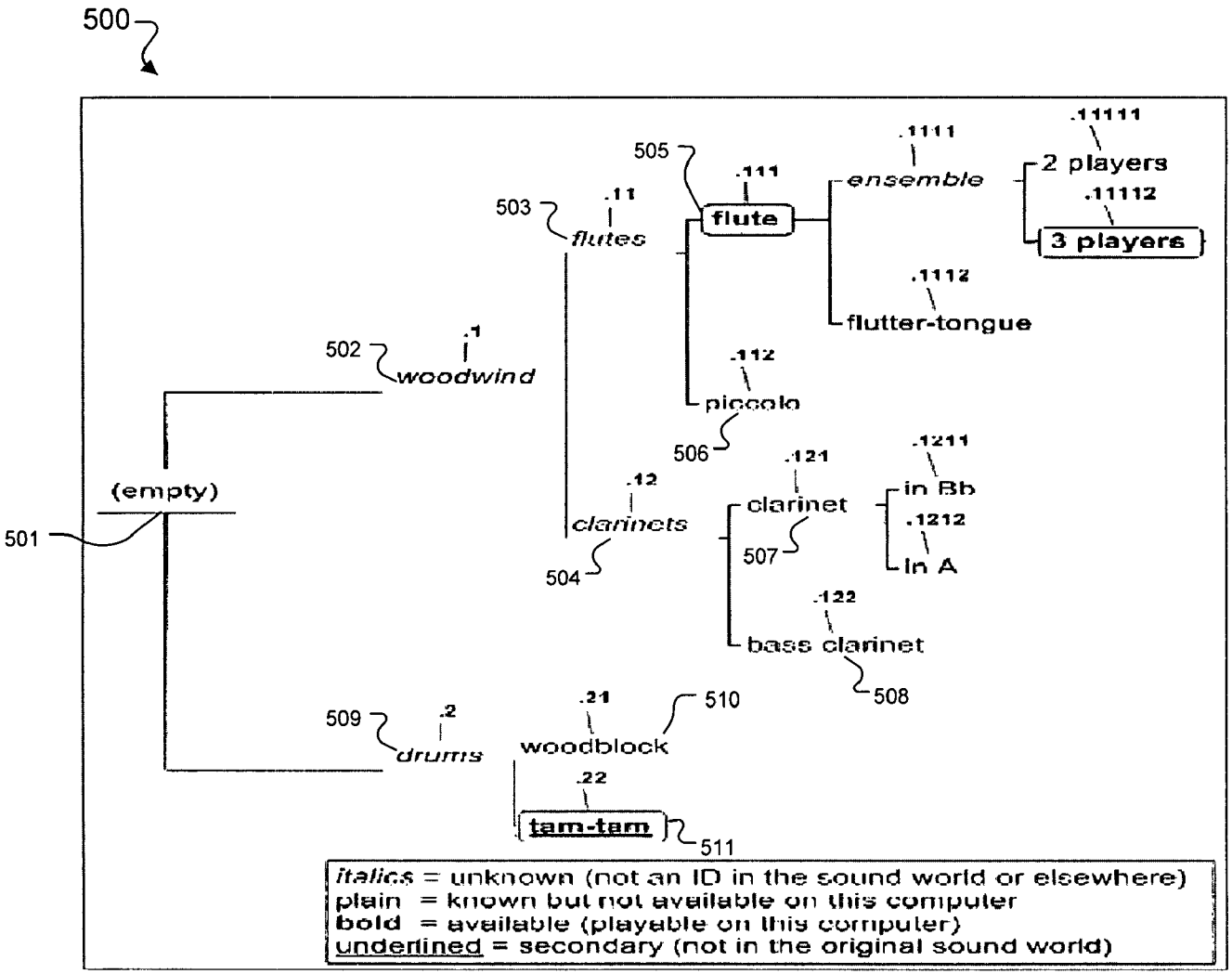
FIG. 5 is another example hierarchical structure for identifying an available audio representation of one or more sounds.

FIG. 5 is another example hierarchical structure 500 for identifying an available audio representation of one or more sounds. In the example shown, each branch and leaf element in the hierarchical structure 500 is labeled with a decimal number having values between and including 0 and 1. The root or empty element 501 is given the value of 0, and each branch further from the root adds a decimal digit. Thus, the woodwind branch 502 is given a value of 0.1. The flutes branch 503, which stem from the woodwind branch 502, are given a value of 0.11. The clarinets branch 504, which also branch from the woodwind branch 502, are given a value of 0.12. The flute branch 505, which stems from the flutes branch 503, is given the value of 0.111 and the piccolo leaf 506, which also stems from the flutes branch 503 is given a value of 0.112. The clarinet branch 507, which stems from the clarinets branch 504, is given a value of 0.121 and the bass clarinet leaf 508, which also stems from the clarinets branch 504, is given a value of 0.122. Numerical values are given to every leaf representing every element on the tree as shown.

Likewise, the drums branch 509 is given the value of 0.2. The woodblock leaf 510, which stems from the drums branch 509, is given the value of 0.21, and the tam-tam leaf 511, which also stems from the drums branch 509, is given the value of 0.22.

In the example shown, in order to find a substitution for woodwind.clarinets.clarinet (0.121), the system will first check all descendants of 0.121. Thus, the system will determine whether a lowest-numbered available node (e.g., branch or leaf) exists in the range of $0.121 \leqq x < 0.122$ (i.e., the lowest number with the same third digit). This means that the system will check woodwind.clarinets.clarinet (0.121), woodwind-.clarinets.clarinet.in Bb (0.1211), and then woodwind.clarinets.clarinet.in A (0.1212).

As none of these sound IDs have corresponding available audio representations, the system will next determine whether a lowest-numbered available node exists in the range of $0.12 \leqq x < 0.13$. This means that the system will check woodwind.clarinets (0.12), then woodwind.clarinets.clarinet (0.121) and its descendants again. In some implementations, the system will not check the descendants a second time. Additionally, the system will check woodwind.clarinets-.bass.clarinet (0.122).

As none of these sound IDs have corresponding available audio representations, the system will next check the parent and descendants of the parent. Thus, the system will next find the lowest-numbered available node in the range of $0.1 \leqq x < 0.2$. Two sound IDs have corresponding available audio representations in this range, namely woodwind.flutes-.flute (0.111), and woodwind.flutes.flute.emsemble.3 players (0.11112). The lowest-numbered available node is woodwind.flutes.flute (0.111), and thus, woodwind.clarinets.clarinet fall back to woodwind.flutes.flute, as woodwind.flutes-.flute is the best available substitution for woodwind.clarinets.clarinet in the sound world.

In another example using the hierarchical structure 500, in order to find a substitution for drums.woodblock (0.21), the system will first check all descendants of 0.21. Thus, the system will first determine if a lowest-numbered available node exists in the range of $0.22 \leqq x < 0.23$. In this case, drums.tam-tam (0.22) is available, and would be provided as a substitute for drums.woodblock.

In the event drums.tam-tam was unavailable, the system would next determine if a lowest-numbered available node exists in the range of $0.2 \leqq x < 0.3$. If the system found no available nodes in that range, the system would next find the lowest-numbered available node in the range of $0.0 > x < 1.0$ Thus, the system would search the entire tree beginning with the empty node. The lowest-numbered available node in the tree would then be woodwinds.flutes.flute (0.111), and thus woodwinds.flutes.flute would be presented as a substitute for drums.woodblock. In some implementations, as noted above, a keyboard element is given the highest priority in a tree so that a piano sound ID, when available, can always be presented as a substitute for an unavailable sound. In other implementations, a silence element is placed at the end of a branch (i.e. as a descendent of a sound) when no available sound can be substituted for that sound.

Figure 6:
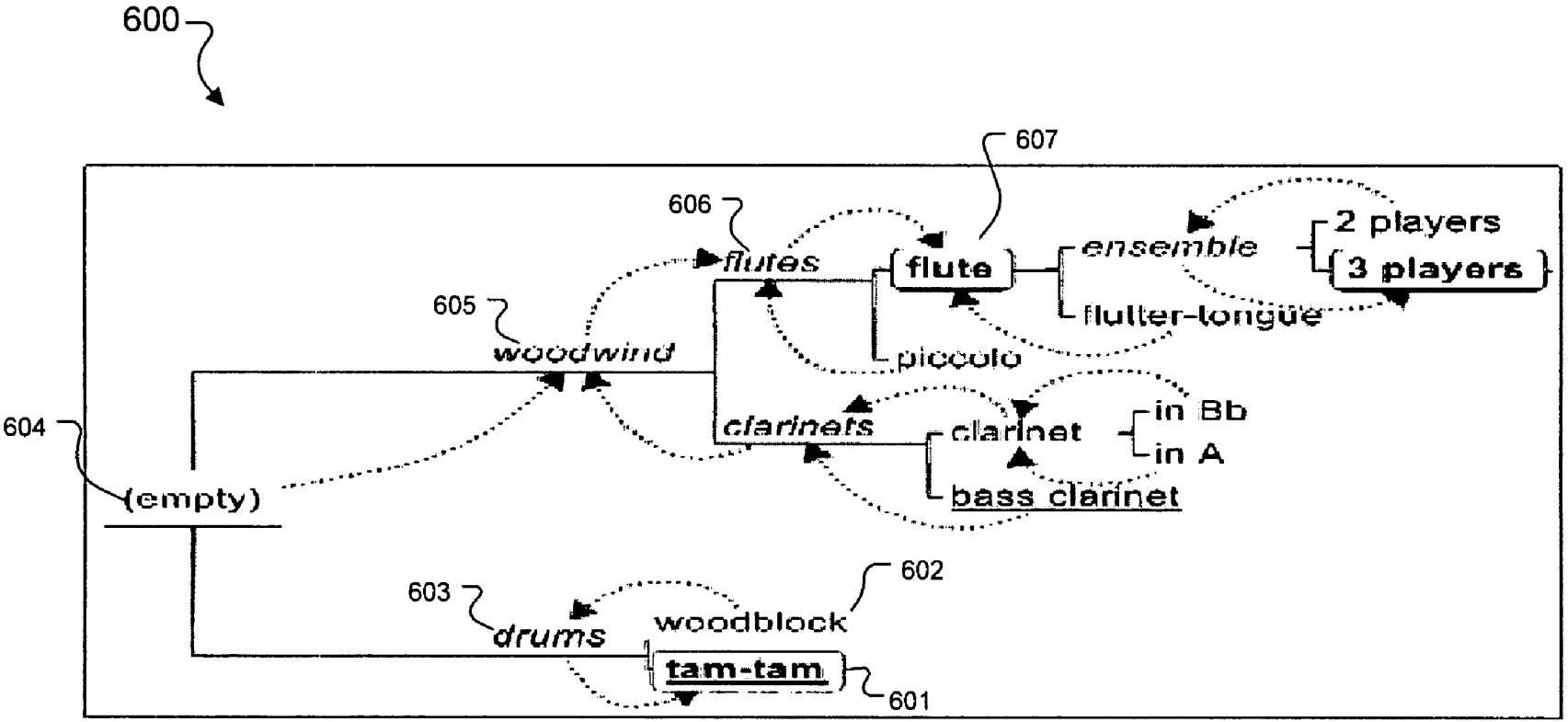
FIG. 6 is an example hierarchical structure 600 for identifying all available audio representations of sounds.

FIG. 6 is an example hierarchical structure 600 for identifying all available audio representations of sounds. In some implementations, the system can substitute the entire hierarchical structure representing the existing sound world with a different hierarchical structure representing a different sound world. In order to create the new hierarchical data structure, the system first gathers data representing all known sound IDs (e.g., sound IDs in the system) and constructs a new hierarchical structure using this data while maintaining the order of the branches in the original sound world hierarchical structure.

Each element in the new hierarchical data structure having an available audio representation corresponding to a sound identified by a sound ID is marked as available. In one implementation, available audio representations corresponding to sounds identified by sound IDs can be gathered by listing all of the sound IDs provided by each of the devices attached to the system. For example, devices attached to the system can be organized into collections of devices known as a "playback configuration". A playback configuration can describe a list of playback devices and the sound IDs associated with each playback device. When a device is added to a playback configuration, the system can gather the sound IDs associated with the added device, and then mark those sound IDs as "available". In the example shown, the tam-tam element 601 is marked as available because it has an available audio representation corresponding to the tam-tam sound.

For each element that is not marked as available (e.g., because there is no available audio representation corresponding to the sound identified by that element), the system creates an association between that element and its child or parent element. In the example shown, this association is depicted using arrows between the elements. Thus, for example, if all the child elements of an element have arrows pointing to that element, those child elements "fall back upon" that element. Thus, that element can not "fall back upon" one of its child elements. Additionally, if there are no children of that element, then that element can not "fall back upon" a child element. Thus, the system creates an association between that element and its parent element.

Creating an association between a child element and a parent element in the hierarchical data structure allows the child element to "fall back upon" the parent element. Thus, the parent element can be substituted for the child element. In the example shown, the woodblock element 602 does not have an available audio representation corresponding to the woodblock sound. Additionally, the woodblock element 602 has no child elements. Thus, the system creates an association between the woodblock element 602 and its parent element, which is the drums element 603.

If there is no parent element, then an element is the root or empty element 604 and no other elements are available. In some implementations, the system can create an association between the empty element 604 and one of its child elements (e.g., a piano element), allowing elements elsewhere in the tree to fall back to that child element using the root element 604. In the example shown, the system has created an association between the empty element 604 and the woodwind element 605. The woodwind element does not have an available audio representation. As a result, the system will follow the associations between the elements until it finds an available audio representation. In the example shown, the arrows depicting the associations between the elements lead from woodwind element 605 to flutes element 606 to flute element 607. Thus, woodwind.flues.flute would be the substitute sound for the root element 604.

After associations between the elements in the hierarchical structure are established, sound IDs can be substituted for one another. This concept is demonstrated by following one or more arrows in the hierarchical structure. For each sound ID, there will be exactly one arrow pointing away. The arrow pointing away from the sound ID (and any subsequent arrows) can be followed until an available audio representation of a sound identified by a particular sound ID is reached. Thus, using the example described above with respect to FIG. 5, the system would need to find a substitution for the sound ID woodwind.clarinets.clarinet because the hierarchical structure indicates that there is no available audio representation for the sound identified by that sound ID.

Thus, the system would first look to the child elements woodwind.clarinets.clarinet.in Bb and woodwind.clarinets.clarinet.in A. As both children have arrows pointing to woodwind.clarinets.clarinet, neither child element would be used as a substitute for woodwind.clarinets.clarinet. Next the system follows the arrow leading from woodwind.clarinets.clarinet to woodwind.clarinets. As woodwind.clarinets does not have an available audio representation for the sound identified by that sound ID, the system follows the arrow from woodwind.clarinets to woodwind. As woodwinds does not have an available audio representation for the sound identified by that sound ID, the system follows the arrow from woodwind to woodwind.flutes. As woodwind.flutes does not have an available audio representation for the sound identified by that sound ID, the system follows the arrow from woodwind.flutes to woodwind.flutes.flute. As woodwind.flutes.flute does have an available audio representation for the sound identified by that sound ID, the system provides woodwind.flutes.flute as a substitute for woodwind.clarinets.clarinet.

Figure 7:
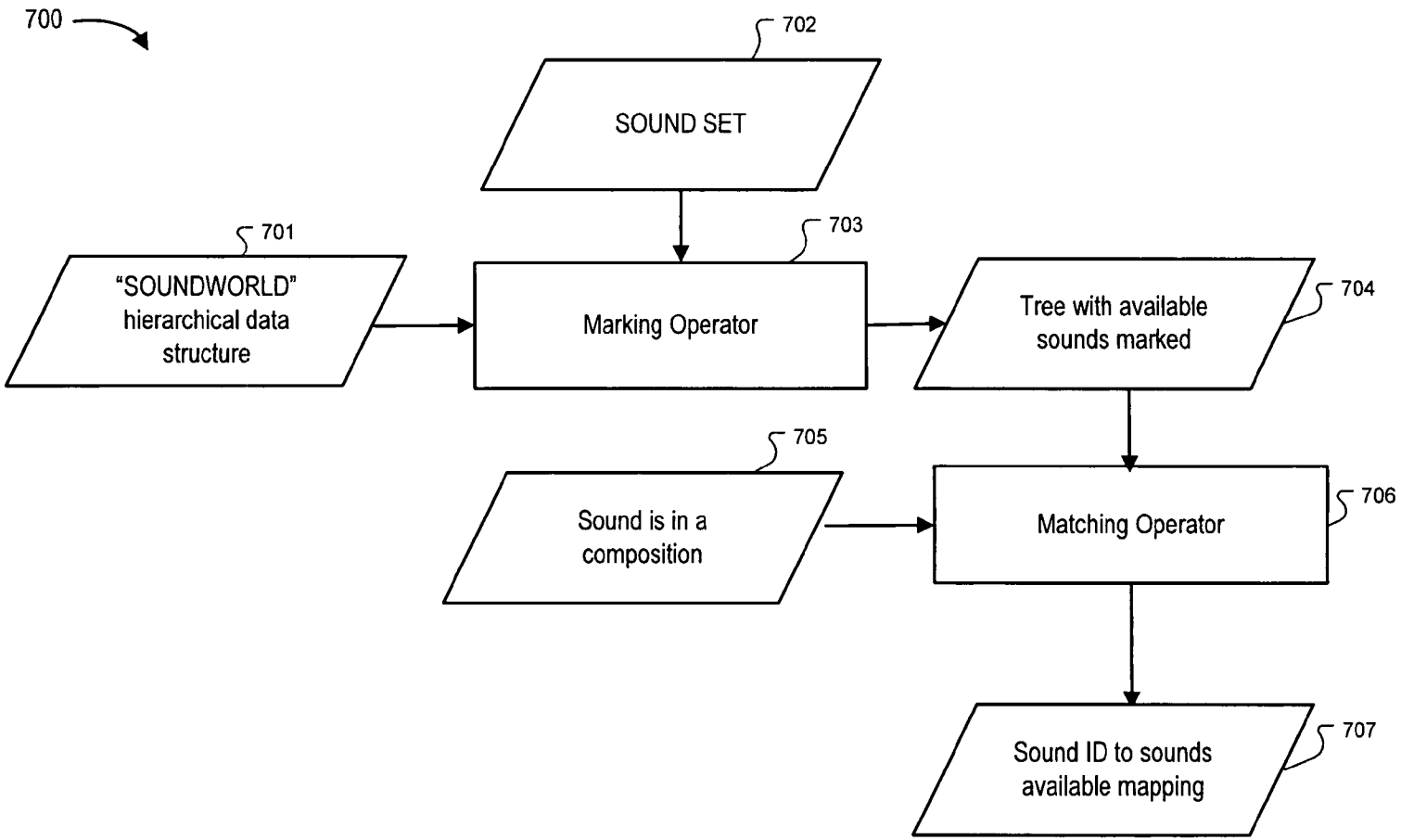
FIG. 7 is a dataflow diagram describing an example system for organizing and using names identifying sounds.

FIG. 7 is a dataflow diagram describing an example system 700 for organizing and using names identifying sounds. The system 700 can receive information describing a hierarchical data structure corresponding to a sound world 701. The system 700 can also receive a data corresponding to a sound set 702. The data corresponding to the sound set 702 can include sounds created in another system or sounds available on a musical device. The system includes a marking operator 703 that receives the hierarchical data structure corresponding to the sound world 701 and the data corresponding to the sound set 702. Using the data corresponding to the sound set 702, the marking operator 703 can mark available sounds in the hierarchical data structure 704.

The system 700 can receive input indicating one or more sound IDs in a musical composition 705. The system includes a matching operator 706 that receives the available sounds in the hierarchical data structure 704 and the one or more sound IDs in the musical composition 705. The matching operator 706 can match available sounds to the one or more sound IDs creating sound IDs that are mapped 707 to particular sounds and available to use in performing the musical composition. The system can substitute mapped sounds for one or more sound IDs in a musical composition 705 in the manner described above with respect to FIGS. 3-6.

Figure 8:
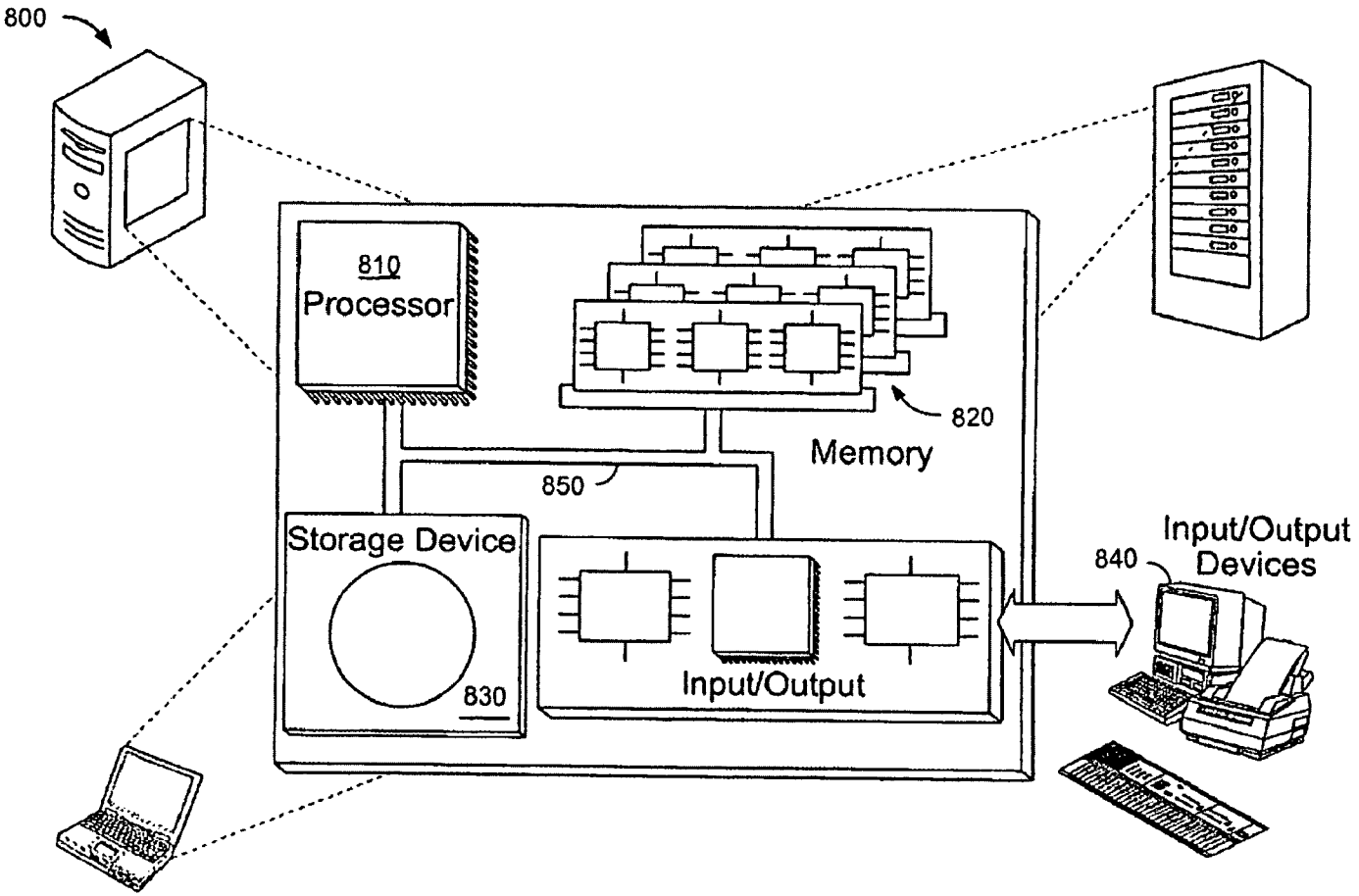
FIG. 8 shows a schematic diagram of an example computer system.

The method described above can be implemented in a computing system. FIG. 8 shows a schematic diagram of an example computer system. The system 800 can be used for practicing operations described in association with the method 100. The system 800 can include a processor 810, a memory 820, a storage device 830, and input/output devices 840. Each of the components 810, 820, 830, and 840 are interconnected using a system bus 850. The processor 810 is capable of processing instructions for execution within the system 800. In one implementation, the processor 810 is a single-threaded processor. In another implementation, the processor 810 is a multi-threaded processor. The processor 810 is capable of processing instructions stored in the memory 820 or on the storage device 830 to display graphical information for a user interface on the input/output device 840.

The memory 820 is a computer readable medium such as volatile or non volatile that stores information within the system 800. The memory 820 can store data structures, for example. The storage device 830 is capable of providing persistent storage for the system 800. The storage device 830 may be a floppy disk device, a hard disk device, an optical disk device, or a tape device, or other suitable persistent storage means. The input/output device 840 provides input/output operations for the system 800. In one implementation, the input/output device 840 includes a keyboard and/or pointing device. The keyboard includes data storage for storing data related to one or more sound IDs and available audio representations corresponding to sounds identified by the one or more sound IDs. In another implementation, the input/output device 840 includes a display unit for displaying graphical user interfaces.

Embodiments of the subject matter and the functional operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them.

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, that is generated to encode information for transmission to suitable receiver apparatus.

A computer program (also known as a program, software, software application, script, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data.

Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described is this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the invention have been described. Other embodiments are within the scope of the following claims. For example, the actions recited in the claims can be performed in a different order and still achieve desirable results.

What is claimed is:

1. A method comprising:

receiving a collection of sound identifiers, each sound identifier identifying a sound, each sound identifier being associated with a corresponding audio representation;

using the collection of sound identifiers to construct a hierarchy of sound identifiers where each sound identifier appears only once in the hierarchy of sound identifiers, and where the hierarchy of sound identifiers is arranged according to a musical similarity between the sounds identified by the collection of sound identifiers;

receiving a selection of a first sound identifier where the first audio representation corresponding to the first sound identified by the first sound identifier is unavailable; and providing an available second audio representation corresponding to a second sound identifier, the second sound identifier identifying a second sound that is musically similar to the first sound identified by the first sound identifier.

2. The method of claim 1, where identifying a sound includes describing a sound using one or more elements.

3. The method of claim 1, where musical similarity between sounds in the hierarchical tree is determined based upon parameters including both an acoustic similarity and a musical suitability.

4. The method of claim 1, where the collection of sound identifiers include sound identifiers from one or more sources.

5. The method of claim 1, further comprising:

creating a set of sound identifiers identifying available audio representations for a specific device.

6. The method of claim 1, where a sound identifier represents silence.

7. The method of claim 1, wherein the second identifier is identified by searching in an order in the hierarchy of sound identifiers.

8. The method of claim 1, wherein musical similarity comprises acoustical similarity.

9. The method of claim 1, wherein identifying a second sound that is musically similar to the first sound identified by the first sound identifier further comprises determining a musical suitability of the second sound for substituting for the first sound identified by the first sound identifier.

10. A method comprising:

receiving a first sound identifier from a collection of sound identifiers arranged in a hierarchical structure, where each sound identifier in the hierarchical structure identifies a sound having a corresponding audio representation;

determining that the audio representation for a first sound identified by the first sound identifier is unavailable;

determining that the audio representation for a second sound is available, the second sound being musically similar to the first sound, the second sound being identifiable by a second sound identifier; and providing the audio representation for the second sound identified by the second identifier.

11. The method of claim 10, where identifying a sound includes describing a sound using one or more elements.

12. The method of claim 10, where musical similarity between sounds in the hierarchical structure is determined based upon several parameters including an acoustic similarity and a musical suitability.

13. The method of claim 10, where determining that the audio representation for a second sound is available includes checking the availability of audio representations corresponding to sounds in the hierarchical structure, where the availability of audio representations are checked in an order in the hierarchical structure.

14. The method of claim 13, where the order includes checking descendants of the first name, checking descendents of the parent of the first name, checking descendents of the grandparent of the first name, and checking descendents of the root node.

15. A computer program product, encoded on a computer-readable medium, operable to cause data processing apparatus to perform operations comprising:

receiving a collection of sound identifiers, each sound identifier identifying a sound, each sound identifier being associated with a particular audio representation;

using the collection of sound identifiers to construct a hierarchy of sound identifiers wherein each sound identifier appears only once in the hierarchy of sound identifiers, and where the hierarchy of sound identifiers is arranged according to a musical similarity between the sounds identified by the collection of sound identifiers;

receiving a selection of a first sound identifier where the first audio representation corresponding to the first sound identified by the first sound identifier is unavailable; and providing an available second audio representation, the available second audio representation corresponding to a second sound that is musically similar to the first sound identified by the first sound identifier.

16. A method comprising:

receiving a hierarchical collection of sound identifiers, each sound identifier identifying a sound, each sound identifier being associated with a particular audio representation;

receiving a selection of a first sound identifier where the first audio representation corresponding to the first sound identified by the first sound identifier is unavailable; and providing an available second audio representation, the available second audio representation corresponding to a second sound that is musically similar to the first sound identified by the first sound identifier.

17. The method of claim 16, where each sound identifier appears only once in the hierarchical collection of sound identifiers, and where the hierarchical collection of sound identifiers is arranged according to a musical similarity between the sounds identified by the collection of sound identifiers.

18. A computer program product, encoded on a computer-readable medium, operable to cause data processing apparatus to perform operations comprising:

receiving a first collection of sound identifiers, each sound identifier identifying a sound, each sound identifier being associated with a particular audio representation;

receiving a second collection of sound identifiers from a first device, each sound identifier identifying a sound, each sound identifier being associated with an available audio representation of a sound on the first device, the second collection of sound identifiers being a subset of the first collection of sound identifiers; and using the second collection of sound identifiers to indicate available audio representations of sounds in the first collection of sound identifiers.

* * * * *